US007980556B2

(12) United States Patent
Mizuno

(10) Patent No.: US 7,980,556 B2
(45) Date of Patent: Jul. 19, 2011

(54) IMAGE FORMING APPARATUS WITH DIFFERENTIAL SHEET CONVEYING FORCE OF DISCHARGING ROOLER PAIR

(75) Inventor: Tatsubumi Mizuno, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/763,526

(22) Filed: Apr. 20, 2010

(65) Prior Publication Data

US 2010/0276871 A1 Nov. 4, 2010

(30) Foreign Application Priority Data

Apr. 30, 2009 (JP) ..... 2009-111010

(51) Int. Cl.
*B65H 5/00* (2006.01)

(52) U.S. Cl. ..... 271/225; 271/186; 271/242; 271/272; 271/902

(58) Field of Classification Search ..... 271/225, 271/186, 902, 242, 272–274
See application file for complete search history.

(56) References Cited

U.S. PATENT DOCUMENTS

| | | | | |
|---|---|---|---|---|
| 4,146,220 | A * | 3/1979 | Barton | 271/902 |
| 4,534,551 | A * | 8/1985 | Jones | 271/902 |
| 4,958,828 | A * | 9/1990 | Saito | 271/902 |
| 6,947,679 | B2 | 9/2005 | Kato et al. | |
| 2008/0179822 | A1 * | 7/2008 | Tu | 271/186 |
| 2009/0295067 | A1 * | 12/2009 | Yanagishita | 271/225 |

FOREIGN PATENT DOCUMENTS

| | | | |
|---|---|---|---|
| JP | 2003-155146 | | 5/2003 |
| JP | 2003155146 | A * | 5/2003 |

* cited by examiner

*Primary Examiner* — Gerald W McClain
(74) *Attorney, Agent, or Firm* — Fitzpatrick, Cella, Harper & Scinto

(57) ABSTRACT

An image forming apparatus has an image forming unit that forms an image on a sheet; a discharging roller pair that discharges the sheet, on which the image is formed, onto a stacking portion with a rotation in a first direction, and conveys the sheet to a re-conveying path for conveying the sheet to the image forming unit again with a rotation in a second direction opposite to the first direction; and a skew feed correction member that is provided in the re-conveying path, and contacts against a leading edge of the sheet conveyed by the rotation in the second direction to correct skew feed of the sheet. The sheet conveying force when contacting the leading edge of the sheet against the skew feed correction member is smaller than sheet conveying force of the discharging roller pair when discharging the sheet onto the stacking portion.

4 Claims, 5 Drawing Sheets

IMAGE FORMING APPARATUS WITH DIFFERENTIAL SHEET CONVEYING FORCE OF DISCHARGING ROOLER PAIR

BACKGROUND OF THE INVENTION

1. Field of the Invention

The present invention relates to an image forming apparatus, and more particularly, to a configuration of a discharging roller pair that delivers a sheet in that image forming apparatus.

2. Description of the Related Art

Heretofore, as an image forming apparatus such as a copier, a laser printer, a LED printer, a facsimile machine, a word processor and multifunction devices of these, there is an image forming apparatus that forms an image on sheets by using an electrophotographic image forming method. In such an image forming apparatus, in general, sheets are supplied one by one to an image forming unit from a sheet feed tray in which a large number of the sheets are stacked and housed, an image is formed on the sheets in the image forming unit based on an image signal inputted thereto, and thereafter, the sheets are delivered to an outside of the apparatus. As such an image forming apparatus, there is one capable of duplex image formation (duplex printing) in which the image is formed on one surface (first surface) of each of the sheets, thereafter, the sheet is reversed by a reversing unit and is conveyed to the image forming unit again, and the image is formed on an opposite surface (second surface) of the sheet.

As a method for the reversing unit of the image forming apparatus capable of the duplex image formation, there is a method of performing a switchback operation for the sheet and reversing the sheet in such a manner that delivery rollers which deliver the sheet to the outside of the apparatus are made capable of positive and reverse rotations, and the delivery rollers are rotated positively and reversely. In the reversing unit of such a switchback method, in the case of reversing the sheet, first, the sheet is delivered partway onto a delivery tray by the delivery rollers in a state where a trailing edge of the sheet in a conveying direction is held. Next, a rotation direction of the delivery rollers is switched to a direction reverse to a delivery direction, whereby the trailing edge of the sheet in the conveying direction is turned to a leading edge thereof, and the sheet is fed into a duplex conveying path for such second surface printing.

With regard to such an image forming apparatus that performs the switchback operation for the sheet and feeds the sheet into the duplex conveying path, in order to correct skew feed of the sheet, which occurs at the time of the switchback operation, a technology for providing a skew feed correction mechanism in a unit of conveying the sheet immediately after being subjected to the switchback operation is disclosed. As such a preliminary skew feed correction method by the skew feed correction mechanism, it is general to use a hit correction method of hitting the leading edge of the sheet under conveyance against a predetermined skew-correcting portion and correcting the skew feed of the sheet (refer to Japanese Patent Application Laid-Open No. 2003-155146).

In the case where the conveying force of the delivery rollers is excessively large when the leading edge of the sheet hits against the skew-correcting portion in the skew feed correction mechanism, there occurs a case where the leading edge of the sheet passes through the skew-correcting portion in a state of not being aligned sufficiently, and a sufficient skew feed correction effect is not obtained.

SUMMARY OF THE INVENTION

The present invention has been made in view of the above-mentioned circumstances. It is an object of the present invention to provide an image forming apparatus capable of enhancing the stacking regularity of the delivered sheets and obtaining a high skew feed correction effect.

The present invention provides an image forming apparatus, including: an image forming unit that forms an image on a sheet; a discharging roller pair that discharges the sheet, on which the image is formed, onto a stacking portion with a rotation in a first direction, and conveys the sheet, on which the image is formed, to a re-conveying path for conveying the sheet to the image forming unit again with a rotation in a second direction opposite to the first direction; and a skew feed correction member that is provided in the re-conveying path, and contacts against a leading edge of the sheet conveyed by the rotation in the second direction of the discharging roller pair to correct skew feed of the sheet, wherein sheet conveying force when contacting the leading edge of the sheet against the skew feed correction member is smaller than sheet conveying force of the discharging roller pair when discharging the sheet onto the stacking portion.

According to the present invention, it is possible to enhance the stacking regularity in the stacking portion and to obtain a high skew feed correction effect.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
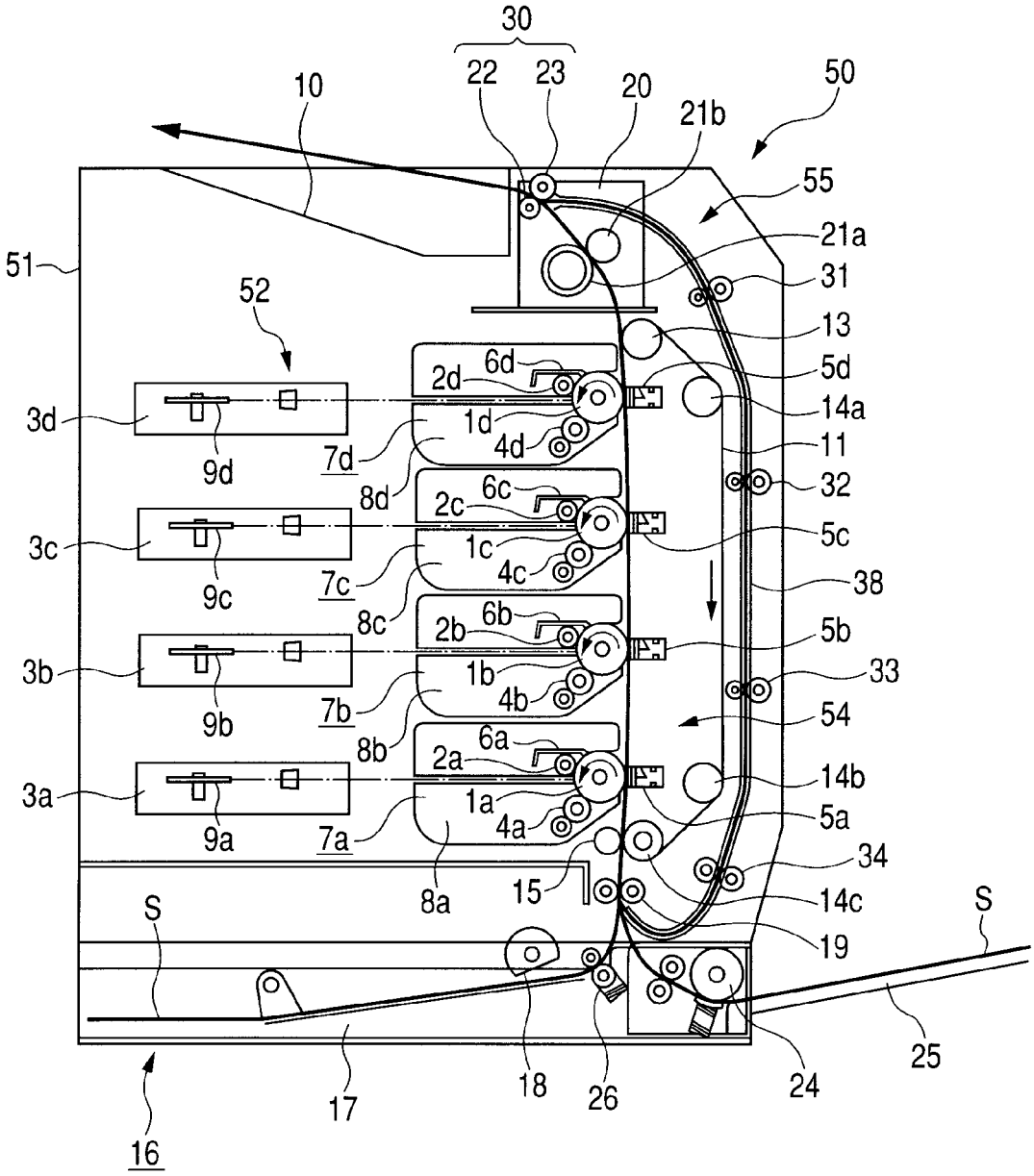
FIG. 1 is an overall configuration diagram of a color laser printer as an example of an image forming apparatus according to a first embodiment of the present invention.

FIG. 1 is an overall configuration view of a color laser printer as an example of an image forming apparatus according to a first embodiment of the present invention.

In FIG. 1, a color laser printer main body 51 (hereinafter, referred to as a printer main body) of a color laser printer 50 includes: an image forming unit 52 that forms an image on sheets; a sheet feeding part 16 that feeds the sheets; a sheet conveying unit 54 that conveys, to the image forming unit 52, the sheets fed from the sheet feeding part 16; a fixing unit 20 that fixes the image formed on the sheets; and the like. The printer main body further includes a re-conveying unit 55 for conveying the sheets, on one-side surfaces of which the image is formed, to the image forming unit 52 again.

The image forming unit 52 includes photosensitive drums 1 (1*a* to 1*d*) as image bearing members which are arranged in an up-and-down direction and bear toner images of four colors, which are yellow, magenta, cyan, and black, respectively. On peripheries of the photosensitive drums 1, there are provided: charging means 2 (2*a* to 2*d*) which uniformly charge surfaces of the photosensitive drums 1 along a rotation direction of the photosensitive drums 1; and scanner units 3 (3*a* to 3*d*) which irradiate the photosensitive drums 1 with laser beams based on image information and form electrostatic latent images on the photosensitive drums 1. On the peripheries of the photosensitive drums 1, developing rollers 4 (4*a* to 4*d*) are provided, which adhere toners contained in toner containing portions 8 (8*a* to 8*d*) onto the electrostatic latent images and turn the electrostatic latent images into visualized images as toner images. Further, cleaning units 6 (6*a* to 6*d*) are provided, which remove the toners remaining on the surfaces of the photosensitive drums after such transferring, and the like.

Each of the photosensitive drums 1 as the image bearing members is configured by applying an organic photoconductor (OPC) on an outer circumferential surface of an aluminum-made cylinder, for example, with a diameter of 30 mm. Both end portions of the photosensitive drum 1 are supported by flanges so as to be freely rotatable, and drive force is transmitted to one of the end portions from a drive motor (not shown), whereby each of the photosensitive drums 1 is rotationally driven in a counterclockwise direction illustrated by an arrow. Each of the charging means 2 is a conductive roller formed into a roller shape. The charging means 2 is allowed to abut against the surface of the photosensitive drum, and a charge bias voltage is applied to the charging means 2 by a power supply (not shown), whereby the surface of the photosensitive drum 1 is uniformly charged. In this embodiment, the photosensitive drum 1, the charging means 2, the developing unit 4, the cleaning unit 6 and the toner containing portion 8 are integrally formed into cartridges, whereby process cartridges 7 (7*a* to 7*d*) are formed.

Each of the scanner units 3 includes a polygon mirror 9 (9*a* to 9*d*) that is arranged in a substantially horizontal direction with the photosensitive drum 1 and rotates by a scanner motor (not shown). A laser diode (not shown) irradiates the polygon mirror 9 with image light corresponding to an image signal. In an inside of an electrostatic conveyor belt 11 as an endless sheet conveying member that is described later and conveys the sheets, transfer units 5 (5*a* to 5*d*) which nip the electrostatic conveyor belt 11 together with the four photosensitive drums 1 are individually provided in combination therewith. The transfer rollers 5 are connected to a transfer bias power supply (not shown), and positive charges are applied from the transfer rollers 5 to each of the sheets through the electrostatic conveyor belt 11. Transfer biases are applied, whereby the negative toner images of the respective colors on the photosensitive drums are sequentially transferred to the sheet in contact with the photosensitive drums 1, and a multi-color image is formed thereon.

The sheet feeding part 16 is constituted by a feed cassette 17, a multi-feed tray 25, a resist roller pair 19 and the like. The feed cassette 17 contains multiple the sheets S therein, and is loaded into a bottom portion of the printer main body. The multi-feed tray 25 is usually stored in a front surface of the printer main body, and at the time of use, is opened as illustrated in FIG. 1, and stacks the sheets S thereon. At the time of image formation, first, the sheets S are fed one by one from the feed cassette 17 by a pickup roller 18. Thereafter, the sheets S are conveyed to the sheet conveying unit 54 by an intermediate conveying roller 26 and the resist roller pair 19 that conveys the sheets S at predetermined timing. At the time of feeding the sheets S from the multi-feed tray 25, first, the sheets S contained in the multi-feed tray 25 are fed one by one by a multi-pickup roller 24. Thereafter, the sheets S are conveyed to the sheet conveying unit 54 by the resist roller pair 19.

The sheet conveying unit 54 includes the electrostatic conveyor belt 11 as a sheet bearing member that is suspended and supported by a drive roller 13 and driven rollers 14*a* to 14*c* and is arranged opposite to all of the photosensitive drums 1. The electrostatic conveyor belt 11 is constituted by a film-like member with a circumferential length of approximately 700 mm and a thickness of approximately 150 μm, which is imparted with a specific volume resistance ranging from $10^{11}$ to $10^{14}$ Ω·cm. The electrostatic conveyor belt 11 is circularly moved by the drive roller 13 in order to electrostatically attract the sheets S on an outer circumferential surface thereof opposite to the photosensitive drums 1, and to bring the sheets S into contact with the photosensitive drums 1. The sheets S are electrostatically attracted to the electrostatic conveyor belt 11 moved circularly, and are thereby conveyed to a transfer position by the electrostatic conveyor belt 11, and the toner images on the photosensitive drums are transferred to the sheets S. Note that an attracting roller 15 is arranged at the most upstream position of the electrostatic conveyor belt 11, nips the sheets S together with the electrostatic conveyor belt 11, and attracts the sheets S to the electrostatic conveyor belt 11. At the time of conveying the sheets S, a voltage is applied to the attracting roller 15, whereby an electric field is formed between the attracting roller 15 concerned and the driven roller 14C installed opposite thereto. Then, dielectric polarization is generated between the electrostatic conveyor belt 11 and the sheets S, and electrostatic attraction force is generated therebetween.

The fixing unit 20 includes: a heating roller 21*a* that rotates and fixes the toner images of the multiple colors, which are transferred to each of the sheets S; and a pressure roller 21*b* that is brought into pressure contact with the heating roller 21*a* and applies heat and pressure to the sheet S. At the time of passing through the fixing unit 20, the sheet S to which the toner images on the photosensitive drums 1 are transferred is conveyed by the heating roller 21*a* and the pressure roller 21*b*, and is applied with the heat and the pressure at the time of being conveyed. In such a way, the toner images of the multiple colors are fixed on the surface of the sheet. The re-conveying unit 55 includes a reverse conveying path 38 as a re-conveying path that reverses the sheet S on which the images are formed, and conveys the sheet S to the image forming unit 52 again. The reverse conveying path 38 includes: a skew feed correction roller pair 31 as a skew feed correction member that corrects skew feed of the sheet; and duplex conveying rollers 32, 33 and 34 which convey, to the resist roller pair 19, the sheet in which the skew feed is corrected by the skew feed correction roller pair 31. In FIG. 1, a discharging roller pair 30 is made capable of positive and reverse rotations. In the case of forming the image on both surfaces of the sheet, the discharging roller pair 30 is rotated reversely to convey the sheet S to the re-conveying unit 55.

Image forming operations of the color laser printer 50 are described. When the laser beams which correspond to the image information and are irradiated from the scanner units 3 are scanned on the surfaces of the photosensitive drums 1 uniformly charged by the charging means 2, the latent images are formed on the surfaces of the photosensitive drums 1. The latent images are developed by the developing units 4, whereby the toner images of the four colors, which are yellow, magenta, cyan, and black, are formed on the surfaces of the photosensitive drums.

Simultaneously with such toner image forming operations, the sheets S contained in the feed cassette 17 are fed one by one by the pickup roller 18. The sheets S contained in the multi-feed tray 25 are fed one by one by the multi-pickup roller 24. Thereafter, each of the sheets S is guided to the resist roller pair 19. Thereafter, the resist roller pair 19 starts to rotate and feeds the sheet S to the electrostatic transfer belt 11 so that a recording start position of the sheet S can coincide with an opposing point to the electrostatic transfer belt 11 at timing when a leading end of the toner image on the circumferential surface of the most upstream photosensitive drum 1 is rotationally conveyed to the opposing point. Next, while being nipped by the electrostatic attracting roller 15 and the electrostatic transfer belt 11, the sheet S is brought into pressure contact with an outer circumference of the electrostatic transfer belt 11, and a voltage is applied between the electrostatic transfer belt 11 and the electrostatic attracting roller 15. In such a way, charges are induced on the sheet S as a dielectric and a dielectric layer of the electrostatic transfer belt 11, and the sheet S is electrostatically attracted onto the outer circumference of the electrostatic transfer belt 11. Thereafter, the sheet S is attracted to the electrostatic transfer belt 11, and is conveyed to the most downstream transfer unit.

By actions of the transfer rollers 5, which are arranged in the respective transfer units and are applied with the voltages with a reverse polarity to that of the toners, the toner images of the respective colors on the photosensitive drums 1 are sequentially superimposed on and transferred to the sheet S conveyed to the transfer units. The sheet S to which the toner images of the four colors are multi-transferred is self-stripped from the electrostatic transfer belt 11 by a curvature of the drive roller 13, and is conveyed to the fixing unit 20. Then, at the time of passing through the fixing unit 20, the sheet S is heated and pressurized, whereby the toner images are permanently fixed onto the sheet S. In the case of delivering the sheet S on one surface of which the image is formed, by the discharging roller pair 30 constituted by a delivery roller 23 and an opposite delivery roller 22, the sheet S is delivered (discharged) to a delivery tray 10 as a stacking portion, which is provided on an upper surface of the printer main body, in a state of facing such an image surface thereof downward. Then, the sheet S is stacked on the delivery tray 10.

Figure 2A:
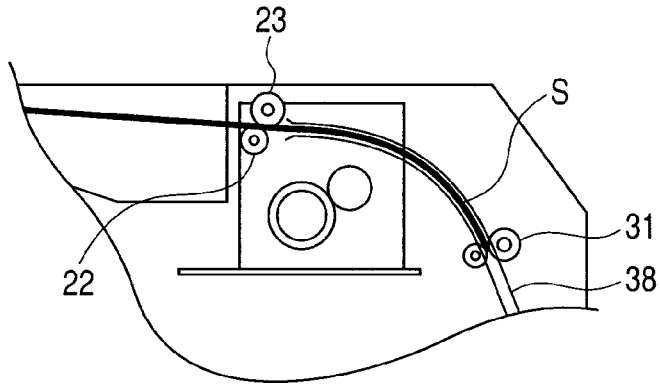
FIGS. 2A, 2B and 2C illustrate switchback sheet conveying operations of the color laser printer.

In the case of forming the image on both surfaces of the sheet, before the discharging roller pair 30 finishes delivering the sheet, on one surface of which the image is formed, to the outside of the printer main body (outside of the apparatus body), the discharging roller pair 30 is rotated reversely, and the sheet S is conveyed to the re-conveying unit 55 in a switchback manner. In such a way, as illustrated in FIG. 2A, the sheet S is conveyed to the reverse conveying path 38, and reaches the skew feed correction roller pair 31. Here, in this embodiment, drive of the discharging roller pair 30 and drive of the skew feed correction roller pair 31 are controlled independently of each other. Accordingly, at the time when the sheet S is conveyed to the reverse conveying path 38 by the reverse rotation of the discharging roller pair 30, the skew feed correction roller pair 31 is on standby in a state of stopping rotation thereof. The skew feed correction roller pair 31 is arranged at a position where a distance between the skew feed correction roller pair 31 and the discharging roller pair 30 is shorter than a length of the sheet in a sheet conveying direction.

Figure 2B:
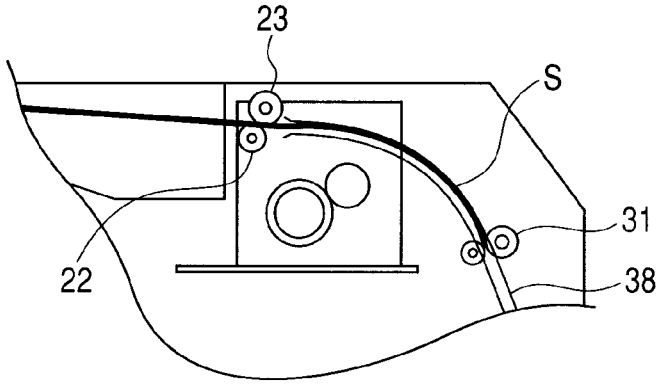

The skew feed correction roller pair 31 is on standby in such a stopped state, whereby the leading edge of the sheet S transferred thereto hits (contacts) against a nip of the skew feed correction roller pair 31 and the sheet S is backed up as illustrated in FIG. 2B. Even during this while, the discharging roller pair 30 continues to feed the sheet S to the reverse conveying path 38. Accordingly, the sheet S forms a loop between the discharging roller pair 30 and the skew feed correction roller pair 31. As the loop is formed, an attitude of the leading edge of the sheet is aligned so as to be parallel to an axial direction of the skew feed correction roller pair 31.

Figure 2C:
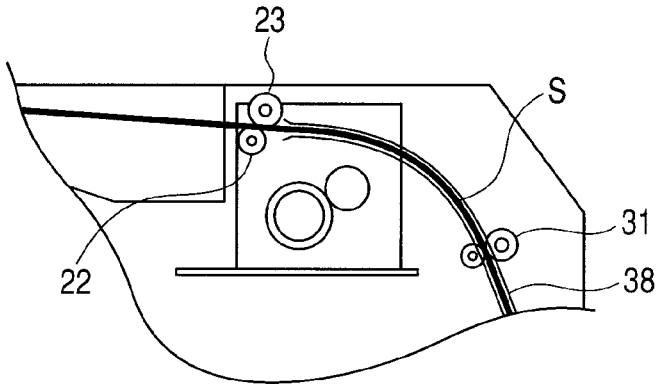

Drive force of a drive source (not shown) is selectively transmitted to the skew feed correction roller pair 31 by a clutch (not shown). Immediately before the skew feed correction roller pair 31, a sensor (not shown) detecting that the sheet has reached is provided. Control is made so that, when the sensor (not shown) provided immediately before the skew feed correction roller pair 31 detects the sheet S, the clutch can be actuated and the skew feed correction roller pair 31 can start to rotate after elapse of a fixed time from such detection. When the drive of the skew feed correction roller pair 31 is started at the point of time when a predetermined time has elapsed after trailing edge detection timing, the sheet S is re-fed toward the image forming unit as illustrated in FIG. 2C. Thereafter, the sheet S is conveyed to the image forming unit 51 again by the duplex conveying rollers 32, 33, and 34 and the resist roller pair 19, and the image is formed on the second surface of the sheet S.

Figure 3:
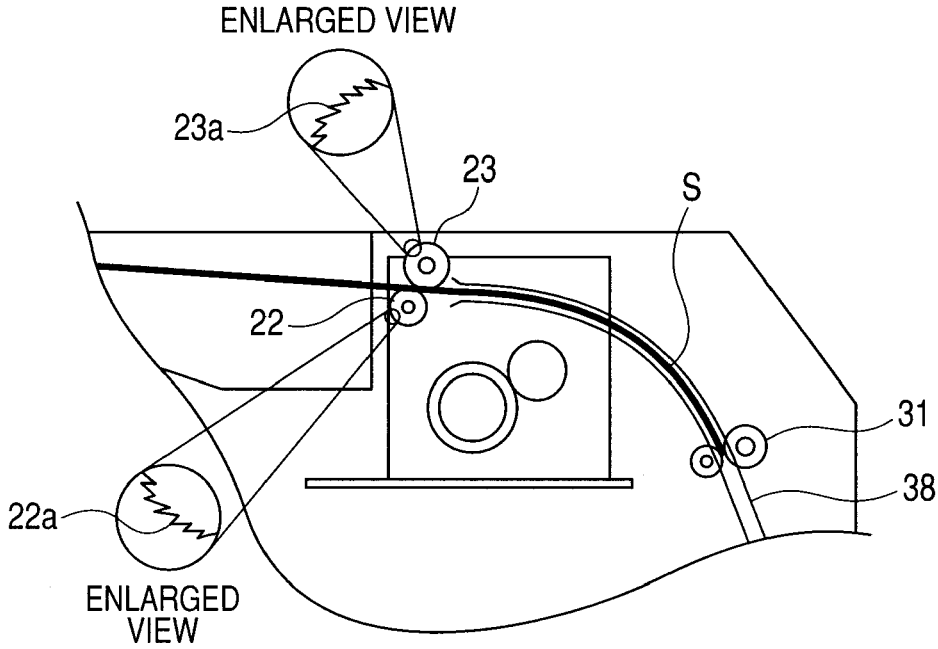
FIG. 3 illustrates a configuration of a discharging roller pair of the color laser printer.

Incidentally, the delivery roller 23 and the opposite delivery roller 22, which are two rollers configuring the discharging roller pair 30, can rotate both positively and reversely upon receiving drive force from a drive source (not shown). Roller surfaces of the delivery roller 23 and the opposite delivery roller 22 are formed of a rubber material, for example, such as foamed silicon so as to be provided with elasticity. Owing to reasons in processing, saw tooth-like polishing marks 22*a* and 23*a* are formed by polishing the roller surfaces along a rotation direction thereof. As illustrated in FIG. 3, the delivery roller 23 and the opposite delivery roller 22 are arranged so that directions of the polishing marks 22*a* and 23*a* formed on such elastic surfaces thus polished can be forward with respect to a delivery direction (sheet delivery direction) to the delivery tray 10.

The delivery roller 23 and the opposite delivery roller 22 are arranged, whereby ridge line portions of the polishing marks 22*a* and 23*a* abut against the sheet and become flat when the discharging roller pair 30 rotates in the delivery direction by the positive rotations thereof. As a result, contact areas of the roller surfaces with respect to the sheet S are widened. Accordingly, grip force by the discharging roller pair 30 is strengthened, that is, nipping force thereby is strengthened, and large conveying force is obtained. Meanwhile, when the discharging roller pair 30 rotates reversely, tip end portions of the polishing marks 22*a* and 23*a* hit against the sheet in a state where the contact areas are small. Accordingly, the grip force is weak, that is, the nipping force is weak (small), and the conveying force is reduced. In this embodiment, the sheet conveying force F1 at the time of the sheet delivery by the discharging roller pair 30 and the sheet conveying force F2 at the time of hitting the sheet against the skew feed correction roller pair 31 satisfy a relationship of F1>F2.

Hence, in the case where the discharging roller pair 30 rotates reversely, the grip force is weak, and the conveying force is small. Therefore, when the sheet S reaches the skew feed correction roller pair 31 as already illustrated in FIG. 2A and FIG. 2B, the leading edge of the sheet S does not break through the nip of the skew feed correction roller pair 31. An attitude of the sheet S nipped by the delivery roller 23 and the opposite delivery roller 22 in such a state where the nipping force is weak is likely to follow the leading edge side of the sheet S, which is aligned by the nip of the skew feed correction roller pair 31. Hence, such a skew feed correction function for the second surface is exerted effectively.

Meanwhile, at the time when the delivery roller 23 and the opposite delivery roller 22 rotate positively, the grip force is strong, and the conveying force is large. Therefore, even if the sheet S is thin paper, for example, with a basis weight of 60 g/m$^2$, the sheet is conveyed without hanging down, and in addition, the sheet S is not delivered in the bent state even if the sheet S contacts the bundle of the sheets previously stacked on the delivery tray 10, and good stacking/alignment regularity can be obtained.

As described above, in this embodiment, the sheet conveying force at the time of the sheet delivery by the discharging roller pair 30 is larger than the sheet conveying force at the time of hitting the sheet against the skew feed correction roller pair 31. In such a way, at the time of delivering the sheets, high conveying force that allows the sheets to be surely stacked on the delivery tray is obtained even if the sheets have varieties of thicknesses and sizes. Further, at the time of conveying the sheets in the switchback manner, low conveying force that allows the attitude of each of the sheets to be likely to follow when a tip end of the sheet hits against the skew feed correction roller pair 31 can be obtained.

Specifically, the discharging roller pair 30 is configured so that a magnitude of the sheet conveying force F1 at the time of the sheet delivery and a magnitude of the sheet conveying force F2 at the time of hitting the sheet against the skew feed correction roller pair 31 can satisfy the relationship of F1>F2, whereby the stacking regularity of the delivered sheets can be enhanced, and a high skew feed correction effect can be obtained. In this embodiment, the polishing marks are formed on both of the delivery roller 23 and the opposite delivery roller 22. However, a similar effect can be obtained if the polishing marks are formed on at least one of the delivery roller 23 and the opposite delivery roller 22.

Figure 4:
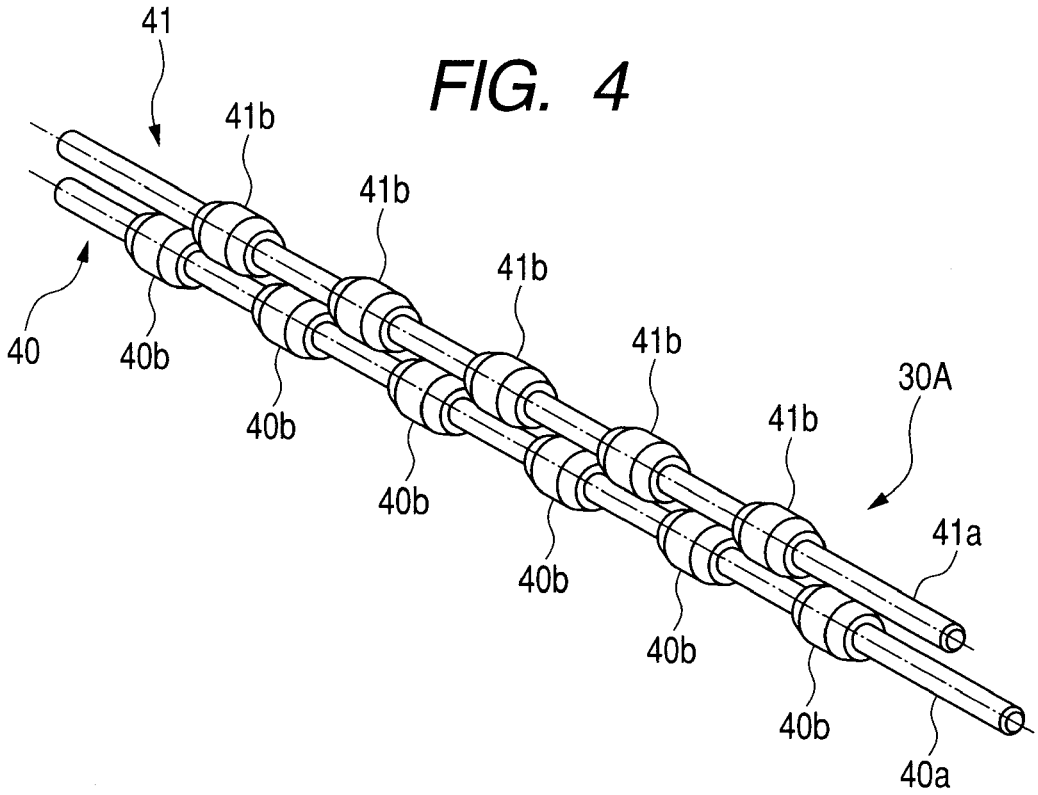
FIG. 4 is a first view illustrating a configuration of a discharging roller pair of the color laser printer according to a second embodiment of the present invention.

A second embodiment of the present invention is described. FIG. 4 is a schematic perspective view illustrating a configuration of a discharging roller pair of an image forming apparatus according to this embodiment. In FIG. 4, a discharging roller pair 30A is configured of two rollers, which are a delivery roller 40 and an opposite delivery roller 41. The delivery roller 40 includes: a roller shaft 40*a*; and multiple roller main bodies 40*b* fixedly mounted on the roller shaft 40*a* at a predetermined interval. The opposite delivery roller 41 includes: a roller shaft 41*a*; and multiple roller main bodies 41*b* fixedly mounted on the roller shaft 41*a* at a predetermined interval. The delivery roller 40 and the opposite delivery roller 41 are arranged so that the mutual roller main bodies 40*b* and 41*b* thereof can be alternately adjacent to each other in a non-contact manner. On outer circumferential surfaces of the delivery roller 40 and the opposite delivery roller 41, saw tooth-like polishing marks similar to those described in the first embodiment are formed.

Figure 5:
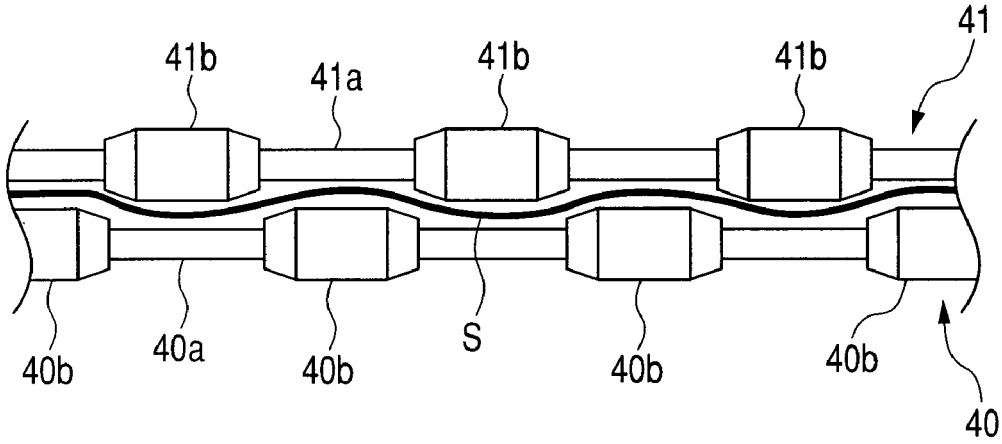
FIG. 5 is a second view illustrating the configuration of the discharging roller pair.

When viewed in the axial direction, the roller main bodies 40*b* of the delivery roller 40 and the roller main bodies 41*b* of the opposite delivery roller 41 overlap each other as illustrated in FIG. 5. Specifically, in this embodiment, the discharging roller pair 30A has a roller configuration of a so-called comb-like roller type, in which these roller main bodies of the two rollers overlap each other in a direction perpendicular to the axial direction when viewed in the axial direction. In such a way, when the sheet passes between the delivery roller 40 and the opposite delivery roller 41, slight wavy stripes (corrugations) extending in the sheet conveying direction are formed on the sheet. In other words, at the time of passing through the discharging roller pair 30A, the sheet heaves in a width direction of the sheet, which is perpendicular to the sheet conveying direction, and thereby stiffness of the sheet in the conveying direction thereof is strengthened. The stiffness of the sheet is strengthened, whereby the leading edge of the sheet S under delivery does not hang down at the time when the sheet is delivered. Accordingly, the sheet is delivered without bringing the leading edge thereof in contact with the bundle of the sheets stacked on the delivery tray, and the staking regularity of the delivered sheets can be enhanced.

In the case where the discharging roller pair 30A has the roller configuration of the comb-like roller type, the delivery roller 40 and the opposite delivery roller do not form the nip. Accordingly, the nipping force for the sheet is reduced to an extreme extent. Therefore, in the case of correcting the skew feed of the sheet by thrusting the sheet against the skew feed correction roller pair 31 at the time of the sheet conveyance for the duplex printing as already described, the sheet comes to slip on the skew feed correction roller pair 31. If the sheet slips, then, at the time of hitting the sheet against the skew feed correction roller pair 31, conveying force of the discharging roller pair 30A, which acts on the skew feed correction roller pair 31, is reduced by an amount of such slippage as compared with the case of delivering the sheet. If the conveying force of the discharging roller pair 30A, which acts on the skew feed correction roller pair 31, is reduced, then the skew feed correction function by the skew feed correction roller pair 31 can be exerted effectively.

Also in this second embodiment, the saw tooth-like polishing marks are formed on the delivery roller 40 and the opposite delivery roller 41. Hence, as in the first embodiment, by actions of the saw tooth-like polishing marks, the sheet conveying force at the time of the sheet delivery by the delivery roller 40 and the opposite delivery roller 41 becomes larger than the sheet conveying force at the time of hitting the sheet against the skew feed correction roller pair 31.

Figure 6:
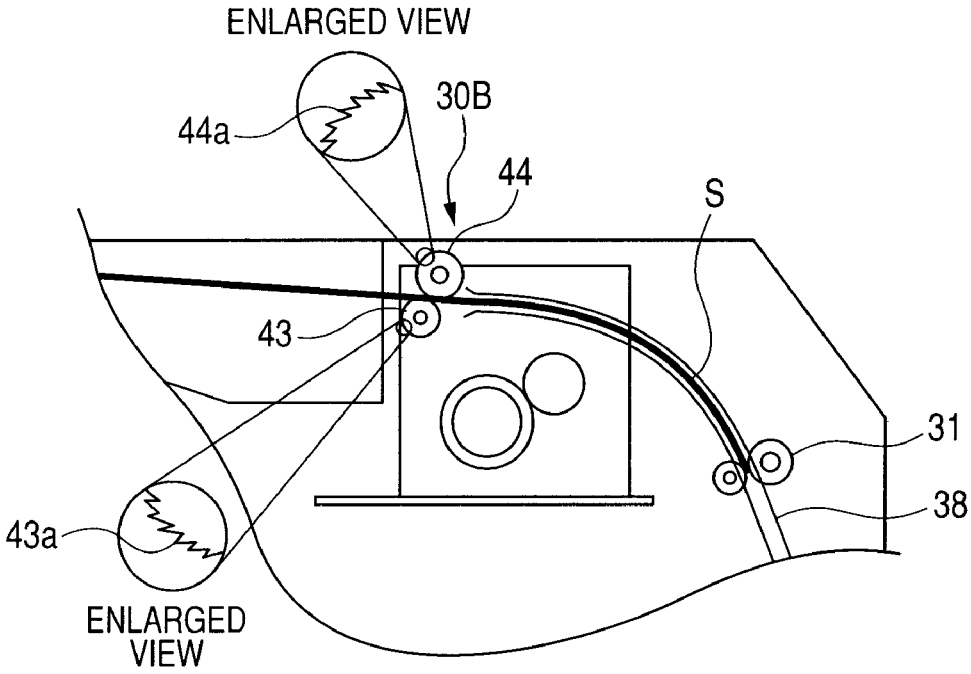
FIG. 6 illustrates a configuration of a discharging roller pair of a color laser printer according to a third embodiment of the present invention.

A third embodiment of the present invention is described. FIG. 6 is a schematic perspective view illustrating a configuration of a discharging roller pair of an image forming apparatus according to this embodiment. In FIG. 6, the same reference numerals as those already illustrated in FIG. 3 denote the same or equivalent portions.

In FIG. 6, a discharging roller pair 30B is constituted by a delivery roller 43 and an opposite delivery roller 44. On surfaces of the delivery roller 43 and the opposite delivery roller 44, polishing marks 43*a* and 44*a* are formed as in the first embodiment already described. The discharging roller pair 30B has the roller configuration of the comb-like roller type in a similar way to the discharging roller pair 30A according to the second embodiment already described. Hence, also in this embodiment, the delivery roller 43 and the opposite delivery roller 44 do not form the nip, and accordingly, nipping and conveying forces for the sheet are extremely small. Hence, in the case of correcting the skew feed of the sheet by thrusting the sheet against the skew feed correction roller pair 31 at the time of the sheet conveyance for the duplex printing as already described, the skew feed correction function by the skew feed correction roller pair 31 can be exerted effectively.

Figure 7A:
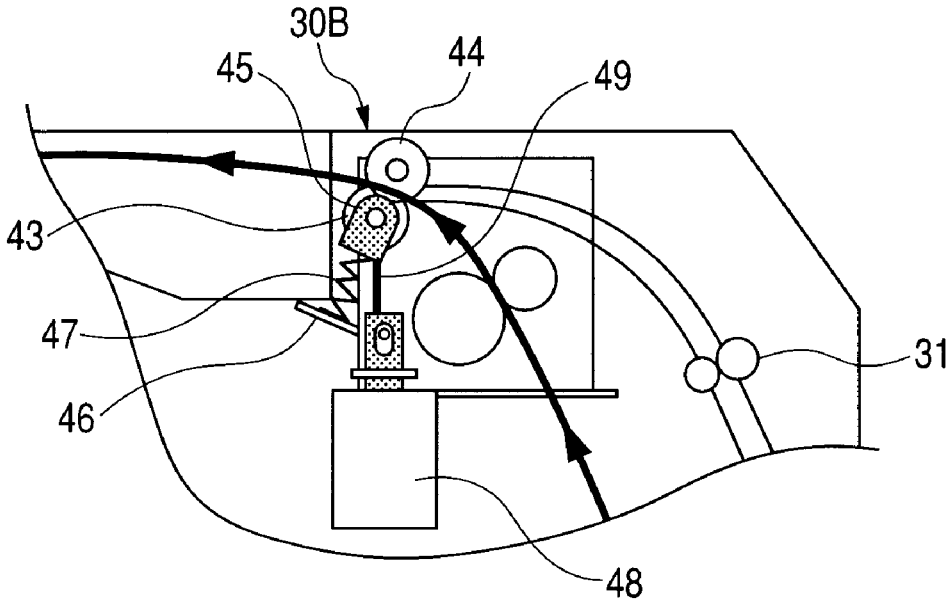
FIGS. 7A and 7B illustrate operations of the discharging roller pair.
Figure 7B:
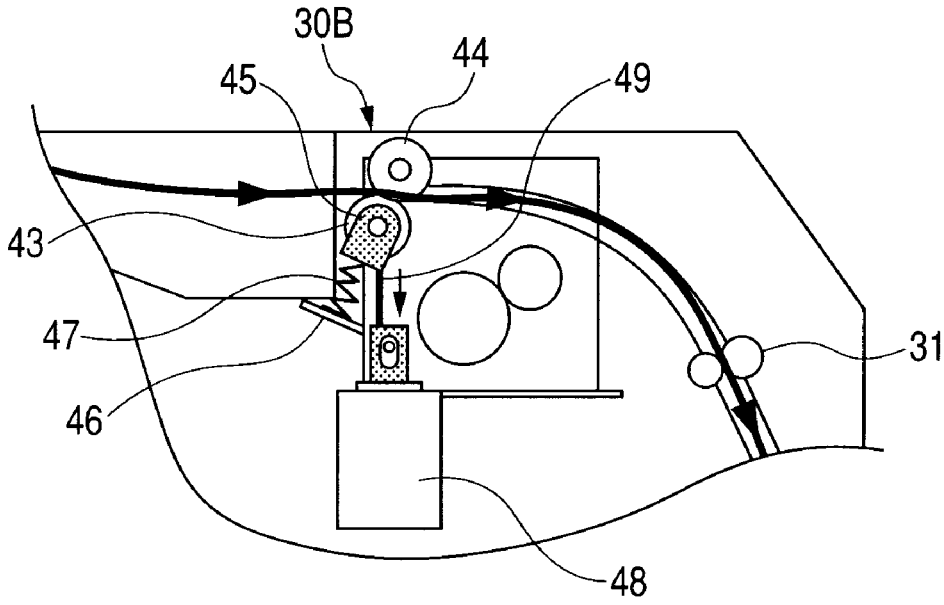

In this embodiment, as illustrated in FIGS. 7A and 7B, both ends of the opposite delivery roller 44 are supported by bearings 45 so as to be freely rotatable. The bearings 45 are provided so as to be movable in the up-and-down direction, and the ends thereof are urged to the opposite delivery roller side by springs 47 fixed to spring bearing surfaces 46 provided in the printer main body 51. In such a way, the delivery roller 43 is brought into pressure contact with the opposite delivery roller 44 so as to be capable of approaching and leaving the opposite delivery roller 44. As an actuator that operates in synchronization with positive and reverse rotations of the delivery roller 44 and the opposite delivery roller 43, a solenoid 48 is coupled to the bearings 45 by coupling members 49.

The solenoid 48 is turned on at the time of the reverse rotation when the discharging roller pair 30B (delivery roller 44 and opposite delivery roller 43) performs the switchback operation. When the solenoid 48 is turned on, the bearings 45 are pulled downward, and a center distance between the axial line of the delivery roller 44 and the axial line of the opposite delivery roller 43 expands. The center distance expands, and hence an overlap amount of outer diameters of the delivery roller 44 and the opposite delivery roller 43 is reduced, and the conveying force is reduced to a large extent. At the time when the discharging roller pair 30B delivers the sheet, the solenoid 48 is turned off, whereby the overlap amount of the outer diameters of the delivery roller 44 and the opposite delivery roller 43 is maintained, and the conveying force of the discharging roller pair 30B is also maintained.

In this embodiment, the solenoid 48 is switched on at the time of the positive rotation of the discharging roller pair 30B, and is switched off at the time of the reverse rotation thereof, whereby the center distance between the delivery roller 44 and the opposite delivery roller 43 is changed. In such a way, the conveying force of the discharging roller pair 30B can be switched so as to be increased at the time of delivering the sheet to the outside of the apparatus, and to be reduced at the time of the sheet conveyance for the duplex printing. Specifically, by such switching of the solenoid 48, at the time of delivering the sheet, the conveying force of the discharging roller pair can be increased more than at the time of the sheet conveyance for the duplex printing. As a result, the stacking regularity of the delivered sheets can be enhanced, and the high skew feed correction effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-111010, filed Apr. 30, 2009, which is hereby incorporated by reference herein in its entirety.

What is claimed is:

1. An image forming apparatus, comprising:

an image forming unit that forms an image on a sheet;

a discharging roller pair that discharges the sheet, on which the image is formed, onto a stacking portion with a rotation in a first direction, and conveys the sheet, on which the image is formed, to a re-conveying path for conveying the sheet to the image forming unit again with a rotation in a second direction opposite to the first direction; and a skew feed correction member that is provided in the re-conveying path, and contacts against a leading edge of the sheet conveyed by the rotation in the second direction of the discharging roller pair to correct skew feed of the sheet, wherein sheet conveying force when contacting the leading edge of the sheet against the skew feed correction member is smaller than sheet conveying force of the discharging roller pair when discharging the sheet onto the stacking portion.

2. An image forming apparatus according to claim 1, wherein:

at least one roller of the discharging roller pair has an elastic surface including polishing marks, the polishing marks being formed by polishing the elastic surface along a rotation direction of the roller; and the polishing marks are arranged so that the sheet conveying force of the discharging roller pair when the discharging roller pair is rotated in the second direction is smaller than the sheet conveying force of the discharging roller pair when the discharging roller pair is rotated in the first direction.

3. An image forming apparatus according to claim 2, wherein:

on each of roller shafts of two rollers of the discharging roller pair, a plurality of roller main bodies are provided at intervals in an axial direction of each of the roller shafts; and the two rollers of the discharging roller pair are arranged so that the mutual plurality of roller main bodies of the two rollers are alternately adjacent to each other in a non-contact manner.

4. An image forming apparatus according to claim 1, wherein:

on each of roller shafts of two rollers of the discharging roller pair, a plurality of roller main bodies are provided at intervals in an axial direction of each of the roller shafts;

the two rollers of the discharging roller pair are arranged so that the mutual plurality of roller main bodies of the two rollers are alternately adjacent to each other in a non-contact manner; and the image forming apparatus further comprises a changing unit that changes a distance between the axial lines of two rollers so that an overlap amount of the roller main bodies of the two rollers in a direction perpendicular to the axial direction is smaller when contacting the leading edge of the sheet against the skew feed correction member than when discharging the sheet onto the stacking portion.

* * * * *